United States Patent [19]

Weyer

[11] Patent Number: 4,508,016

[45] Date of Patent: Apr. 2, 1985

[54] ROTARY ACTUATED SUPPORT

[76] Inventor: Paul P. Weyer, 48811 28th Ave. Southeast, Enumclaw, Wash. 98022

[21] Appl. No.: 530,977

[22] Filed: Sep. 9, 1983

[51] Int. Cl.[3] ..... F01B 3/08

[52] U.S. Cl. ..... 92/33; 92/113; 92/116; 92/136; 92/161

[58] Field of Search ..... 92/31, 33, 113, 116, 92/136, 161; 74/89.15; 403/1, 309, 347, 359; 308/174, 220, 222, 231, 234

[56] References Cited

U.S. PATENT DOCUMENTS

| | | | |
|---|---|---|---|
| 3,977,262 | 8/1976 | Randolph | 74/89.15 |
| 4,161,344 | 7/1979 | Delarbre et al. | 308/222 |
| 4,168,869 | 9/1979 | Stephan | 308/174 |

FOREIGN PATENT DOCUMENTS

| | | | |
|---|---|---|---|
| WO81/03199 | 11/1981 | PCT Int'l Appl. | 92/33 |

*Primary Examiner*—Robert E. Garrett
*Assistant Examiner*—Scott L. Moritz
*Attorney, Agent, or Firm*—Seed and Berry

[57] ABSTRACT

A fluid-powered, rotary actuated support, including an elongated cylindrical body having ports for introducing pressurized fluid therein; a platform concentric with the cylindrical body and rotatable relative thereto; a radially extending bearing support joined to the cylindrical body and confronting the platform; bearings disposed between the bearing support and the platform for allowing relative rotational movement between the platform and the bearing support, with one of the platform or bearing support being subjected to bending loads disposed in a generally vertical plane from the weight of a crane or other device and its load; a longitudinally splined output shaft rotatably disposed within the body and having a drive end for providing rotational drive between the body and the platform, the splines being loosely fitted to the platform for substantially isolating the shaft from non-rotational movement of the platform, the shaft being bearingless and radially floating within the body for transferring rotational torque between the body and the platform without causing bending of the output shaft under the bending loads of the crane or other device, the drive end of the shaft being radially movable under the bending loads; and a linear-to-rotary actuator disposed within the body and operable to provide relative rotational movement between the body and the output shaft, the actuator being operable while the output shaft drive end is being subjected to radial movement.

10 Claims, 3 Drawing Figures

ROTARY ACTUATED SUPPORT

DESCRIPTION

Technical Field

The present invention relates generally to actuators, and more particularly, to rotary actuated supports of the type used to support cranes and other devices in which linear movement of a piston in an actuator produces relative rotary movement between a body and a platform.

Background Art

Rotary helical actuators have been employed in the past and offer the advantages of high-torque output capabilities from a simple linear piston-and-cylinder drive arrangement. One such actuator is shown in U.S. Pat. No. 4,313,367. A shortcoming of such rotary helical actuators, however, is that if the rotary motion on the output shaft is used to rotate a platform or base to which a crane or other device is mounted, loads on the crane or other device cause bending loads which are transmitted through the platform to the output shaft of the actuator. The radial movement of the output shaft resulting from the bending loads will cause the shaft, the piston sleeve, or the ring gear of the actuator to bind, thus inhibiting operation of the actuator and possibly damaging the actuator. While crane-supporting-type platforms typically use large turntable bearings to support the crane and its load, the bearings permit an appreciable amount of radial and axial movement of the platform when under a bending load. This movement results in tilting of the platform relative to the actuator's body and even some sideways movement of the platform which is transmitted to the actuator's output shaft. The output shaft of the actuator is generally maintained by bearings within the body of the actuator; however, these bearings cannot practically be made with sufficient size and strength to avoid the binding problem discussed above when subjected to the forces produced by a crane and its load, particularly when the boom of the crane is carrying a load while reaching a long distance from the platform.

It will therefore be appreciated that there has been a significant need for a rotary actuated platform capable of operating under the bending loads typically encountered with cranes and other devices. Preferably, the actuator should be substantially isolated from the non-rotational movements of the platform, and the actuator should be operable even when subjected to the forces resulting from transmission of some non-rotational movement to the output shaft. The present invention fulfills this need and further provides other related advantages.

DISCLOSURE OF THE INVENTION

The present invention resides in a fluid-powered, rotary actuated support. The support has an elongated cylindrical body with ports for introducing pressurized fluid therein; a platform concentric with the cylindrical body and rotatable relative thereto; a radially extending bearing support joined to the cylindrical body and confronting the platform; load-carrying bearing means between the bearing support and the platform for allowing relative rotary motion between the platform and the bearing support, one of the platform or bearing support being subjected to bending loads disposed in a generally vertical plane from the weight of the crane or other device and its load; an output shaft rotatably disposed within the body and having a drive end for providing rotational drive between the body and the platform; flexible coupling means coupling the drive end of the output shaft to the platform for transferring rotational torque between the body and the platform without causing bending of the output shaft from the bending loads of the crane or other device, the drive end being radially movable under the bending loads; and a linear-to-rotary transmission means disposed within the body and operable to provide relative rotational movement between the body and the output shaft the transmission means being operable while the output shaft drive end is subjected to the radial movement.

More specifically, in the presently preferred embodiment of the invention, the output shaft has a splined end portion spaced from the drive end, and the transmission means includes a splined piston sleeve encircling the output shaft and meshing with the splined end portion, a splined ring gear secured to the cylindrical body and meshing with the splined piston sleeve, and an end seal surrounding the output shaft adjacent to the drive end and loosely fitting in the cylindrical body to allow limited radial movement of the drive end of the output shaft. The piston sleeve extends axially along the output shaft and terminates in a free end disposed toward the drive end of the output shaft. The piston sleeve has a piston end remote from the free end, and the free end of the piston sleeve is unrestricted for allowing its radial movement to accommodate radial movement of the drive end of the output shaft.

The output shaft is bearingless and radially floating within the cylindrical body. Bending loads are substantially carried by the load-carrying bearing means, with the linear-to-rotary transmission means operating substantially isolated from the non-rotational movement caused by the bending loads.

In one preferred embodiment of the invention, the bearing support underlies the platform, and the platform is adapted to be attached to a crane or other device, with the bending loads being transmitted to the platform. In an alternative embodiment of the invention, the bearing support overlies the platform and the body is adapted to be attached to the crane or other device, with the bending loads being transmitted to the body and thence to the bearing support.

The bearing support includes a flange rigidly attached to and extending generally radially from the body and having a bearing-supporting end portion radially remote from the body and positioned adjacent to the platform. Bearings are circumferentially positioned around the body and between the bearing-supporting end portion and the platform. The bearing means further includes a circumferential wall rigidly attached to the platform and extending axially beyond the bearing-supporting end portion of the flange and radially inward, with bearings circumferentially positioned around the body and between the bearing-supporting end portion and the radially extending portion of the circumferential wall.

Other features and advantages of the invention will become apparent from the following detailed description, taken in conjunction with the accompanying drawings.

BEST MODE FOR CARRYING OUT THE INVENTION

Figure 1:
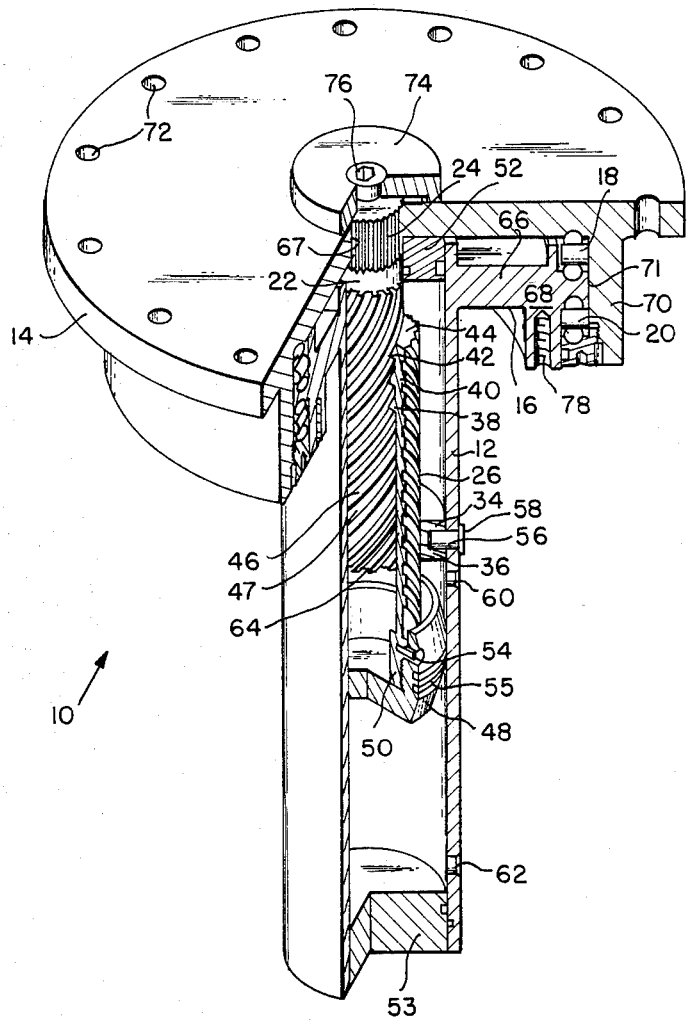
FIG. 1 is an isometric view of a rotary actuated support embodying the present invention.

As shown in the drawings for purposes of illustration, the present invention is embodied in a rotary actuated support, indicated generally by reference numeral 10. The support 10 includes an elongated, cylindrical body 12, a rotatable platform 14 concentric with the cylindrical body, a radially extending bearing support 16 rigidly joined to the body and confronting the platform, load-carrying bearings 18 and 20 disposed between the bearing support and the platform for allowing relative rotary motion between the platform and the bearing support, an output shaft 22 rotatably disposed within the body and having a longitudinally splined drive end 24 for providing rotational drive between the body and the platform, and a linear-to-rotary actuator 26 disposed within the body and operable to provide relative rotational movement between the body and the output shaft. In one embodiment of the invention, the platform 14 provides a mount for a crane or other device, shown in FIG. 2 only as a crane base plate 28 with a clevis 30 mounted thereto. In an alternative embodiment of the invention shown in FIG. 3, the support 10 has an inverted orientation, with the platform 14 being attachable to a stationary deck 31 and the cylindrical body 12 forming a base of a crane or other device, referred to generally by reference numeral 32.

In the illustrated preferred embodiments, the actuator 26 has a conventional linear-to-rotary transmission means which includes a ring gear 34 with inner helical splines 36 and a piston sleeve 38 having outer helical splines 40 over a portion of its length which mesh with the helical splines of the ring gear. The piston sleeve 38 is also provided with inner helical splines 42 positioned towards a free end 44 of the sleeve which mesh with helical splines 46 provided on a splined end portion 47 of the output shaft 22 spaced from the drive end 24 of the shaft. It should be understood that while helical splines are shown in the drawings and described herein, the principle of the invention is equally applicable to any form of linear-to-rotary motion conversion means.

The actuator 26 has a piston 48 threadably attached to a head end portion 50 of the piston sleeve 38 remote from the free end 44 of the sleeve. A key 54 maintains the relative positioning of the piston 48 on the sleeve 38. The piston 48 is slidably maintained within the body 12 for reciprocal movement, and undergoes longitudinal rotational movement relative to the body, as will be described in more detail below.

The ring gear 34 is joined to the body 12 by a plurality of pins 56 which are uniformly positioned about and extend through a plurality of ring gear fastening holes in the body. The pins 56 each have a head 58 which attaches the pins to the body 12. The ring gear 34 may be locked stationary in the position shown in the drawings or may be provided with circumferential slots which loosely receive the pins 56 to allow the ring gear to float about the pins.

As will be readily understood, reciprocation of the piston 48 occurs when hydraulic fluid or air under pressure enters a first port 60 to one side of the piston 48 or through a second port 62 to the other side of the piston. As the piston 48 and the piston sleeve 38 attached thereto linearly reciprocate in an axial direction within the body 12, the outer helical splines 40 of the piston sleeve engage or mesh with the inner helical splines 36 of the ring gear 34 to cause rotation of the piston sleeve. The linear and rotational movement of the piston sleeve 38 is transmitted through the inner helical splines 42 of the piston sleeve to the outer helical splines 46 of the output shaft 22 to cause the shaft to rotate. Depending on the slope and direction of turn of the various helical splines, there may be provided a multiplication of the rotary output of the shaft 22.

A seal carrier 52 is positioned between the output shaft 22 and the body 12 toward the drive end 24 of the shaft 22 to provide a fluid-tight seal therebetween. The seal carrier fits loosely between the output shaft 22 and the body 12 to allow limited non-rotational movement of the shaft caused by bending loads. A fluid-tight seal is provided at the other end of the body 12 by a seal-carrying threaded end cap 53. A pair of O-rings 55 are retained on the piston 48 to define fluid-tight compartments to either side of the piston which communicate with the first and second ports 60 and 62, respectively.

The output shaft 22 of the actuator 26 is bearingless and radially floating within the body 12, with a free end 64 remote from the drive end 24. The platform 14 has a central, longitudinally splined opening 67 to receive the longitudinally splined drive end 24 of the shaft 22. The splines of the central opening 67 and the corresponding splines of the drive end 24 are sized to provide a loose radial fit therebetween. The shaft 22 provides rotational drive between the body 12 and the platform 14, but substantially isolates the shaft 22 from non-rotational tilting movement of the platform resulting from bending loads applied to the platform or the bearing support 16, which loads are disposed in a generally vertical plane due to the weight of the crane or other device or their load. To the extent any non-rotational movement is applied to the shaft 22, the shaft has a radially floating design which allows substantial rocking movement of the shaft within the body 12 without binding of the splined end portion 47 of the shaft to the piston sleeve 38 or the piston sleeve to the ring gear 34. The free end 44 of the piston sleeve 38 may move radially, substantially unrestricted to accommodate the radial movement of the drive end 24 of the shaft 22. This allows the actuator 26 to operate normally while subjected to forces caused by the non-rotational movement of the shaft 22 as a result of bending loads.

In the preferred embodiments of the invention, the bearing support 16 is a flange 66 rigidly attached to and extending generally radially from the body 12. The flange 66 has a bearing-supporting end portion 68 radially remote from the body 12 for retaining the bearings 18 and 20. The platform 14 is provided with a circumferential wall 70 rigidly attached to the platform and extending axially beyond the bearing-supporting end portion 68 of the flange 66 and then radially inward. The bearings 18 are circumferentially positioned around the body 12 and between the platform and the bearing-supporting end portion 68 of the flange 66, and the bearings 20 are circumferentially positioned around the body and between the bearing-supporting end portion 68 and the radially extending portion of the circumferential wall 70. A radial bearing 71 is disposed between the bearing-supporting end portion 68 and the circumferential wall 70.

The platform 14 is provided with a plurality of holes 72 extending therethrough for attachment of the crane or other device base plate 28 to the platform, or, in the alternative embodiment, attachment of the platform to a deck 31. A seal-carrying cap 74 is attached to the drive end 24 of the shaft 22 by a threaded fastener 76 to provide a sealed cover to prevent the entry of moisture or dirt through the central opening 66 of the platform 14.

Figure 2:
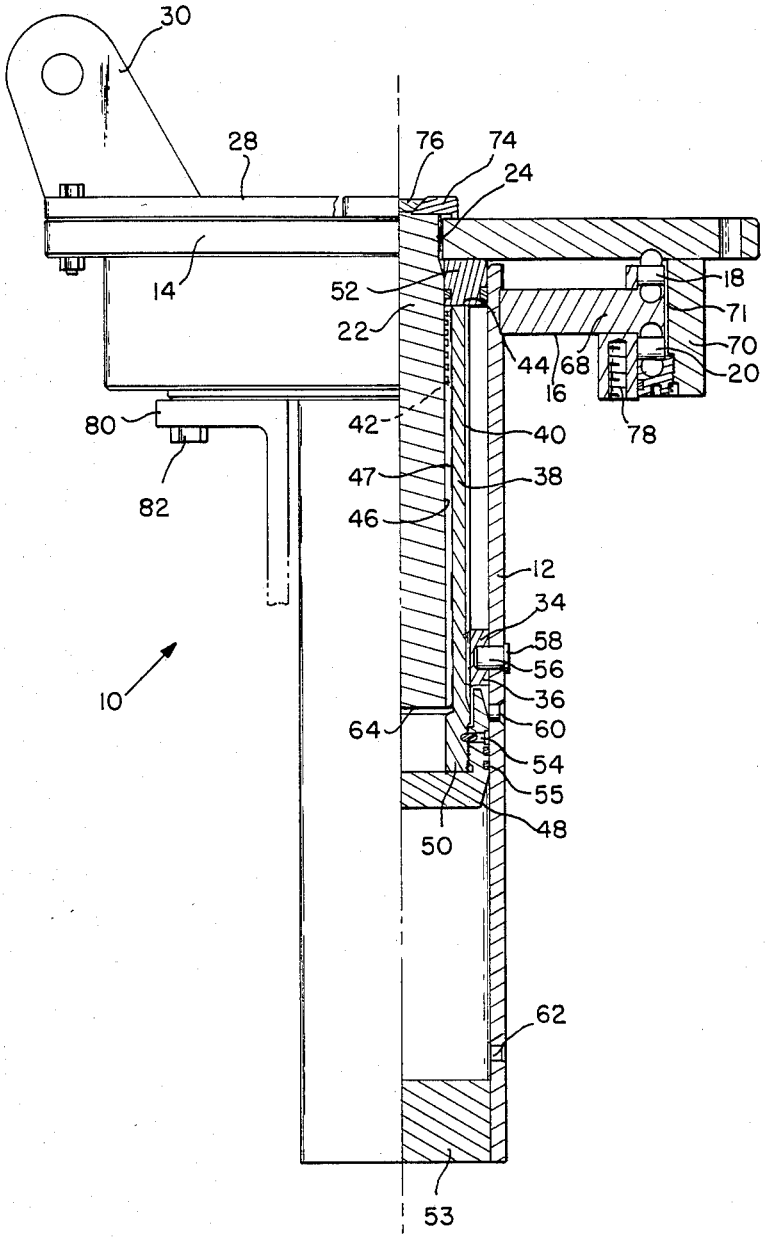
FIG. 2 is a sectional elevational view of the rotary actuated support shown in FIG. 1 showing attachment of a crane base to the platform and the cylindrical body positioned in a stationary post.
Figure 3:
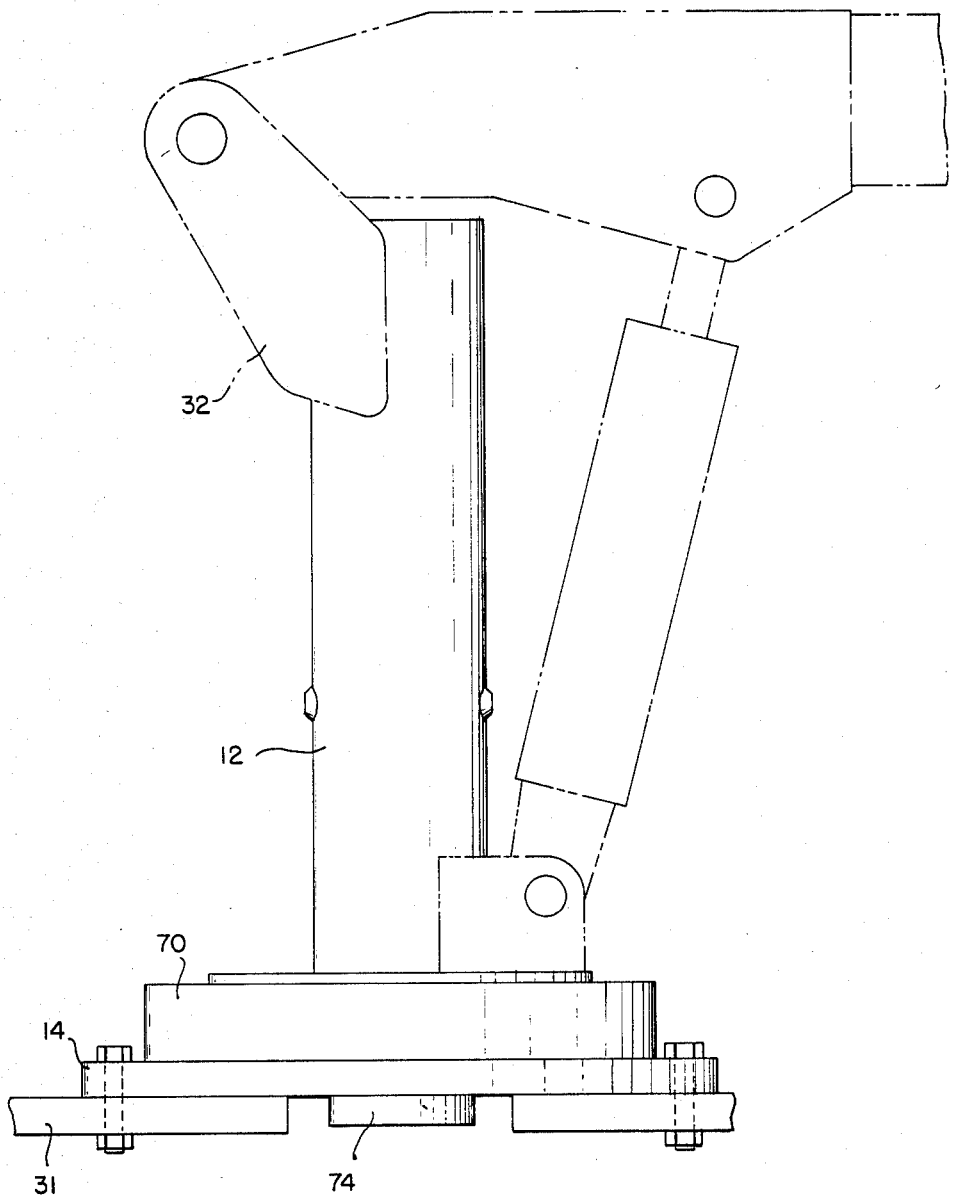
FIG. 3 is an elevational view of an alternative embodiment of the rotary actuated support shown in FIG. 1, shown with the platform attached to a deck and the cylindrical body forming the base of a crane.

As shown in FIGS. 1 and 2, the flange 66 is provided with a plurality of threaded holes 78 for attachment of the support 10 to a stationary post 80 by a plurality of threaded fasteners 82. The post 80 may be attached to a deck or other surface.

It will be appreciated that, although a specific embodiment of the invention has been described herein for purposes of illustration, various modifications may be made without departing from the spirit and scope of the invention. Accordingly, the invention is not limited except as by the appended claims.

I claim:

1. A fluid-powered, rotary actuated support for a crane or other device, comprising:

an elongated cylindricl body having ports for introducing pressurized fluid therein;

a platform concentric with said cylindrical body and rotatable relative thereto;

a radially extending bearing support joined to said cylindrical body and confronting said platform;

load-carrying bearing means disposed between said bearing support and said platform for allowng relative rotary motion between said platform and said bearing support, said bearing means being external to said body and not subject to said pressurized fluid therein, one of said platform or bearing support being subjected to bending loads disposed in a generally vertical plane from the weight of the crane or other device and its load;

an output shaft rotatably disposed within said body and having a drive end for providing rotational drive between said body and said platform;

flexible coupling means coupling said drive end of said output shaft to said platform for transferring rotational torque between said body and said platform without causing bending of said output shaft from said bending loads of said crane, said drive end being radially movable under said bending loads; and linear-to-rotary transmission means disposed within said body and operable to provide relative rotational movement between said body and said output shaft, said transmission means being operable while said output shaft drive end is subjected to said radial movement.

2. The support of claim 1 wherein said output shaft has a splined end portion spaced from said drive end, and said transmission means includes a splined piston sleeve encircling said output shaft and meshing with said splined end portion, a splined ring gear secured to said cylindrical body and meshing with said splined piston sleeve, and an end seal surrounding said output shaft adjacent to said drive end and loosely fitted in said cylindrical body to allow limited radial movement of said drive end of said output shaft, said piston sleeve extending axially along said output shaft and terminating in a free end disposed toward said drive end of said output shaft, said piston sleeve having a piston end remote from said free end, said free end of said piston sleeve being substantially unrestrained for allowing radial movement to accommodate radial movement of said drive end of said output shaft.

3. The support of claim 1 wherein said bearing support underlies said platform, and said platform is adapted to be attached to the crane, said bending loads being transmitted to said platform.

4. The support of claim 1 wherein said bearing support overlies said platform and said body is adapted to be attached to the crane, said bending loads being transmitted to said body and thence to said bearing support.

5. A fluid-powered rotary mount, comprising:

an elongated cylindrical body having ports for introducing pressurized fluid therein;

a rotatable platform for mounting of a crane or other device;

load-carrying bearing means external to said body for rotatably supporting said platform relative to said body;

a bearingless, splined output shaft rotatably disposed within said body and having a splined drive end adapted for coupling to said platform to provide rotational drive thereto, said splined drive end being substantially isolated from nonrotational movement of said platform and being radially movable without substantial bending of said output shaft; and linear-to-rotary transmission means disposed within said body and operable to provide relative rotational movement between said body and said output shaft, said transmission means being operable while subjected to forces caused by non-rotational movement of said platform transmitted through said shaft and including a splined piston sleeve having a piston head for application of fluid pressure to one or the other side of said head to produce linear movement of said piston sleeve within said body, and a splined ring gear joined to said body, said ring gear splines meshing with said piston sleeve splines and said piston sleeve splines meshing with said shaft splines to translate linear movement of said piston sleeve into rotational movement of said shaft, whereby the load of a crane or other device mounted to said platform is substantially carried by said bearing means, and said linear-to-rotary transmission means operates substantially isolated from non-rotational movement of said platform caused by the load.

6. The mount of claim 5 wherein said bearing means includes a flange rigidly attached to and extending generally radially from said body and having a bearing-supporting end portion radially remote from said body positioned adjacent to said platform, said bearing means further including bearings circumferentially positioned around said body and between said bearing-supporting end portion and said platform.

7. The mount of claim 6 wherein said bearing means further includes a circumferential wall rigidly attached to said platform and extending axially beyond said bearing-supporting end portion of said flange and then radially inward, said bearing means further including bearings circumferentially positioned around said body and between said bearing-supporting end portion and said radially extending portion of said circumferential wall.

8. The actuator mount of claim 5 wherein said linear-to-rotary transmission means includes a seal carrier positioned between said body and said shaft toward said drive end, said seal carrier loosely fitting therebetween to allow limited non-rotational movement of said shaft caused by non-rotational movement of said platform.

9. A fluid-powered rotary mount, comprising:

an elongated cylindrical body having ports for introducing pressurized fluid therein;

a rotatable platform for mounting of a crane or other device;

load-carrying bearing means external to said body for rotatably supporting said platform relative to said body;

a bearingless, radially floating output shaft rotatably disposed within said body and having a splined drive end adapted for coupling to said platform to provide rotational drive thereto, said drive end splines being loosely fitted to said platform for substantially isolating said shaft from non-rotational movement of said platform; and linear-to-rotary transmission means disposed within said body and operable to provide relative rotational movement between said body and said output shaft, said transmission means being operable while subjected to forces caused by non-rotational movement of said platform transmitted through said shaft and including a piston for application of fluid pressure to one or the other side of said piston to produce linear movement of said piston within said body, and means for translating linear movement of said piston into rotational movement of said shaft relative to said body.

10. The mount of claim 9 wherein said drive end is radially movable without substantial bending of said output shaft.

* * * * *